US006772904B1

(12) United States Patent
Gilliam et al.

(10) Patent No.: US 6,772,904 B1
(45) Date of Patent: Aug. 10, 2004

(54) CONTAINER FOR FOOD PRODUCTS

(75) Inventors: Cheryl M. Gilliam, Grayslake, IL (US); Anne Bucher, Palatine, IL (US)

(73) Assignee: Kraft Foods Holdings, Inc., Northfield, IL (US)

( * ) Notice: Subject to any disclaimer, the term of this patent is extended or adjusted under 35 U.S.C. 154(b) by 0 days.

(21) Appl. No.: 09/579,661

(22) Filed: May 26, 2000

(51) Int. Cl.[7] ..... B65D 8/12; B65D 43/16

(52) U.S. Cl. ..... 220/836; 220/254.3; 220/833; 220/675

(58) Field of Search ..... 220/836, 675, 220/674, 670, 669, 837, 839, 254.3, 254.4, 254.6

(56) References Cited

U.S. PATENT DOCUMENTS

| | | | |
|---|---|---|---|
| 685,900 | A | 11/1901 | Anderson |
| 827,124 | A | 7/1906 | Speer |
| 1,943,979 | A | 1/1934 | Lundvall |
| 3,246,792 | A | 4/1966 | Brackmann et al. |
| 3,412,890 | A | 11/1968 | Rich |
| 3,417,897 | A | 12/1968 | Johnson |
| D219,958 | S | 2/1971 | Clark |
| 3,695,481 | A | 10/1972 | Foster et al. |
| 3,812,993 | A | 5/1974 | Yoshioka et al. |
| 3,831,798 | A | 8/1974 | Rowe et al. |
| 3,872,996 | A | 3/1975 | Dogliotti |
| 4,143,695 | A | 3/1979 | Hoehn |
| 4,428,497 | A | 1/1984 | Julius et al. |
| 4,471,881 | A | 9/1984 | Foster |
| D276,400 | S | 11/1984 | Daenen et al. |
| 4,724,977 | A | 2/1988 | Cleevely et al. |
| 4,848,626 | A | 7/1989 | Waters |
| 4,872,996 | A | 10/1989 | Grierson et al. |
| 4,898,292 | A | 2/1990 | VerWeyst et al. |
| 4,925,041 | A | 5/1990 | Pehr |
| 5,027,963 | A | 7/1991 | Robbins, III |
| D322,219 | S | 12/1991 | Falco |
| 5,083,671 | A | 1/1992 | Hayes |
| 5,085,339 | A | 2/1992 | Roth et al. |
| 5,092,474 | A | 3/1992 | Leigner |
| 5,133,470 | A | 7/1992 | Abrams et al. |
| 5,145,088 | A | 9/1992 | Goujon |

(List continued on next page.)

FOREIGN PATENT DOCUMENTS

| | | |
|---|---|---|
| DE | 3629718 | 3/1988 |
| DE | 3926140 | 2/1990 |
| EP | 0 990 408 B1 | 9/2003 |
| FR | 2529865 | 1/1984 |

OTHER PUBLICATIONS

U.S. patent application Ser. No. 09/579,662, Gilliam et al.
U.S. patent application Ser. No. 29/157,658, Gilliam et al.
U.S. patent application Ser No. 10/153,077, Gilliam et al.

*Primary Examiner*—Stephen K. Cronin
*Assistant Examiner*—Niki M. Eloshway
(74) *Attorney, Agent, or Firm*—Fitch, Even, Tabin & Flannery

(57) ABSTRACT

The invention provides a container for viscous dressing products that includes a jar and a closure or lid. The lid may be hingedly attached to the container so as to remain attached to the jar after opening. The container provides protection for the viscous dressing product during packaging, shipping, handling, retail display and consumer use, and also makes the viscous dressing readily accessible to the consumer. The container preferably includes a shelf or wiper on the closure to permit the consumer to swipe a serving utensil on the shelf to remove excess viscous dressing product from the utensil. The jar is preferably provided with improved handling characteristics as compared with prior art jars of circular cross section. In the preferred embodiments, the shape of the jar as viewed in plan is generally oval.

24 Claims, 10 Drawing Sheets

U.S. PATENT DOCUMENTS

| | | | | |
|---|---|---|---|---|
| 5,146,088 | A | | 9/1992 | Kingham et al. |
| 5,158,190 | A | | 10/1992 | Sosenko |
| 5,180,072 | A | | 1/1993 | Oehlert |
| 5,211,301 | A | | 5/1993 | Groya et al. |
| 5,261,544 | A | | 11/1993 | Weaver, Jr. |
| D345,305 | S | | 3/1994 | Host |
| D346,720 | S | | 5/1994 | Onneweer |
| 5,358,130 | A | | 10/1994 | Mengeu et al. |
| D351,969 | S | | 11/1994 | Daenen et al. |
| 5,366,104 | A | | 11/1994 | Armstrong |
| D363,218 | S | | 10/1995 | Mann |
| 5,474,199 | A | | 12/1995 | Julius et al. |
| 5,511,684 | A | | 4/1996 | Weaver, Jr. |
| 5,582,314 | A | | 12/1996 | Quinn et al. |
| 5,586,681 | A | * | 12/1996 | Policappelli ..... 220/674 |
| D381,560 | S | | 7/1997 | Indekeu |
| D383,671 | S | | 9/1997 | Phillips |
| 5,669,526 | A | | 9/1997 | Keyfauver |
| D395,204 | S | | 6/1998 | Wood |
| D399,654 | S | | 10/1998 | Mandell |
| D407,974 | S | | 4/1999 | Zimmer et al. |
| 5,893,489 | A | | 4/1999 | Giarrante |
| 5,938,068 | A | | 8/1999 | Atkins et al. |
| D416,797 | S | | 11/1999 | Rabe et al. |
| 6,170,719 | B1 | * | 1/2001 | Wilkinson et al. ..... 222/479 |
| D443,483 | S | | 6/2001 | Gilliam et al. |
| D444,027 | S | | 6/2001 | Gilliam et al. |

* cited by examiner

CONTAINER FOR FOOD PRODUCTS

FIELD OF THE INVENTION

The invention relates generally to containers for food products, and more particularly to a container including a jar and a closure or lid for containing viscous dressing products.

BACKGROUND AND DESCRIPTION OF RELATED ART

The invention relates to packaging for food items, and in particular, to reclosable containers. The prior art includes reclosable screw top jars within which spreadable foods are contained, e.g., containers for foods such as mayonnaise, Miracle Whip® dressing, other viscous dressings, jams, jellies, nut butters and spreads. Such containers are intended to permit insertion of a knife, spoon or other utensil into the container. In providing a container for this type of product, among the considerations that must be addressed are the ability of the container to receive food product in high-speed commercial filling operations; the degree of difficulty that will be encountered by the consumer in removing product from the container; the ability of the container to withstand various loads, such as stacking loads, during filling, sealing, shipping, display, and consumer use; the ability of the container to be packed efficiently among like containers; the cost of manufacture of the container; the ability of the container to exclude air to enable acceptable shelf life to be maintained, and the costs and difficulty associated with forming, filling and sealing the container. It is also important that containers of this type be aesthetically pleasing where they are intended to be displayed for commercial sale to consumers in grocery stores and/or other retail establishments.

One of the problems with existing containers of this type is that, during dispensing, residual quantities of food product may accumulate on the threads at the top of the jar. Another problem is that the jar may be difficult to hold securely.

It is a general object of the invention to provide an improved, commercially viable container for food products which adequately addresses the considerations cited above.

SUMMARY OF THE INVENTION

The invention provides a container for viscous dressing products that includes a jar and a closure or lid. The lid may be hingedly attached to the container so as to remain attached to the jar after opening. The container provides protection for the viscous dressing product during packaging, shipping, handling, retail display and consumer use, and also makes the viscous dressing readily accessible to the consumer. The container preferably includes a shelf or wiper on the closure to permit the consumer to swipe a serving utensil on the shelf to remove excess viscous dressing product from the utensil.

The jar is preferably provided with improved handling characteristics as compared with prior art jars of circular cross section. In the preferred embodiments, the shape of the jar as viewed in plan is generally oval, with flat sidewalls, an effectively flat bottom wall and rounded end walls. Labeling may be attached to the sidewalls to describe the viscous dressing product and the suggested use of the viscous dressing product of the container. The side walls of the jar comprise a raised brow ridge protruding near the top of each side wall. Preferably, the brow ridge has a concave lower surface located centrally of the side wall so that the thumb of a consumer gripping the container may nestle in the curve of the brow ridge. Beneath the brow ridge, the walls include texture to improve engagement of the container by the consumer. The container may be shaped to as to be suggestive of a slice of bread.

Preferably, the closure is securely attached to the jar, and the lid of the closure sealably closes the container as desired by the consumer. The lid is configured to snap into a closed position. The closure includes a flexible hinge attaching the lid to the body of the closure. The closure is generally oval-shaped in plan to fit atop the oval-shaped jar. The closure has a wide opening, to easily permit a consumer to remove viscous dressing product using a serving spoon. The shelf or wiper is preferably positioned within the closure. The shelf is preferably horizontal and the edge of the shelf is preferably perpendicular to the side walls of the jar. The top surface of the lid is preferably flat.

DETAILED DESCRIPTION OF THE PREFERRED EMBODIMENTS

Figure 1:
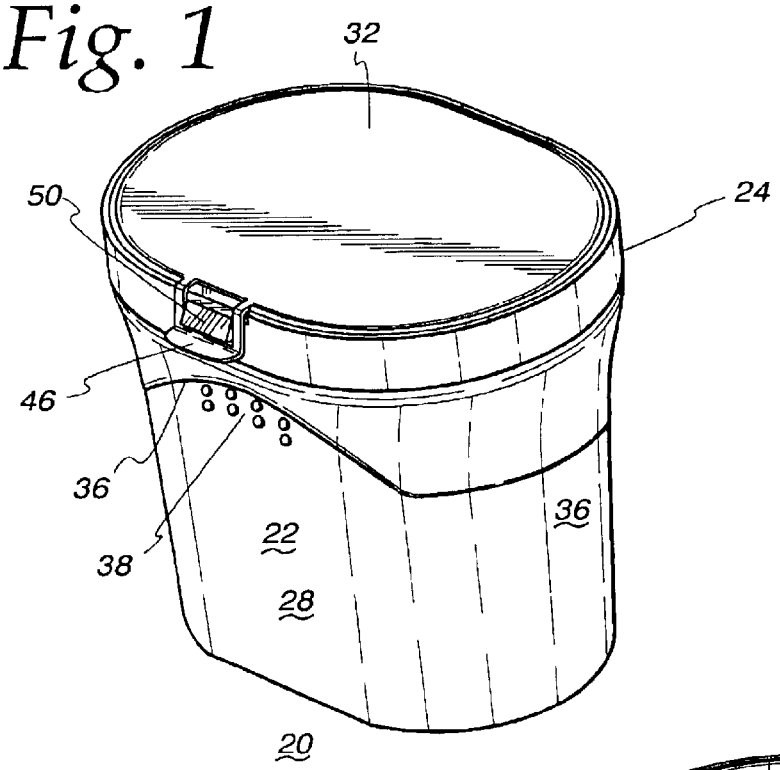
FIGS. 1 and 2 are perspective views illustrating a container in accordance with a first embodiment of the invention.
Figure 2:
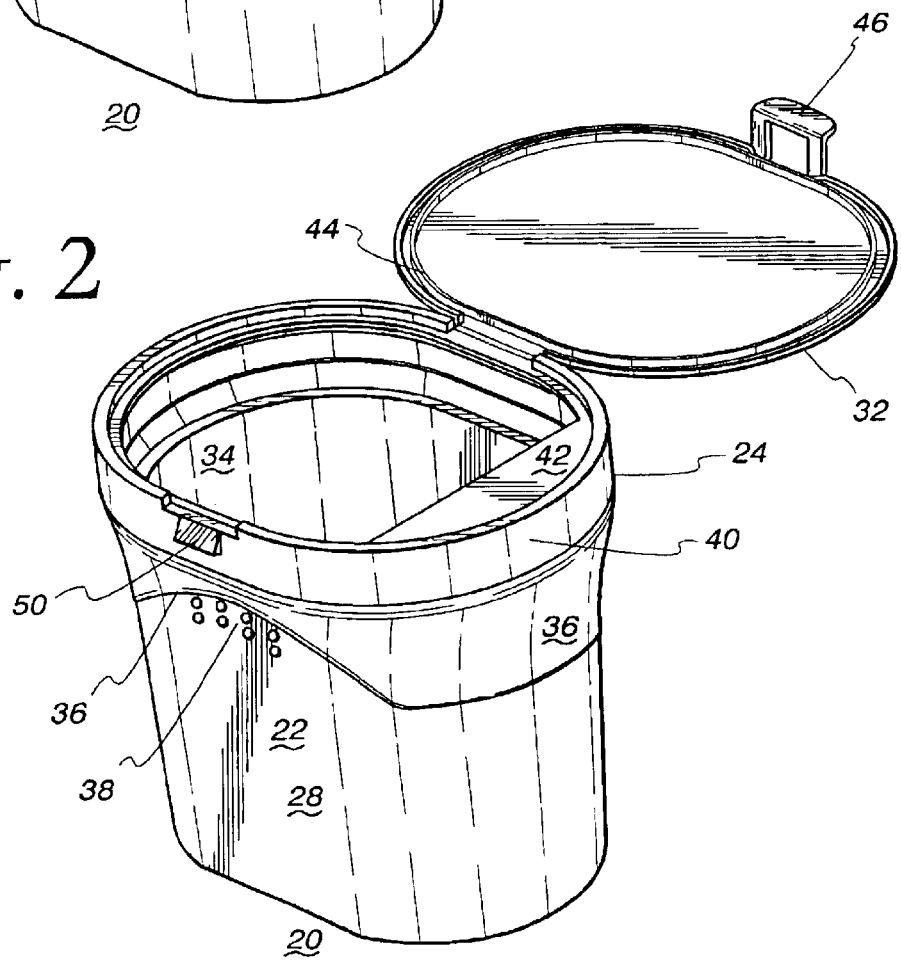
Figure 3:
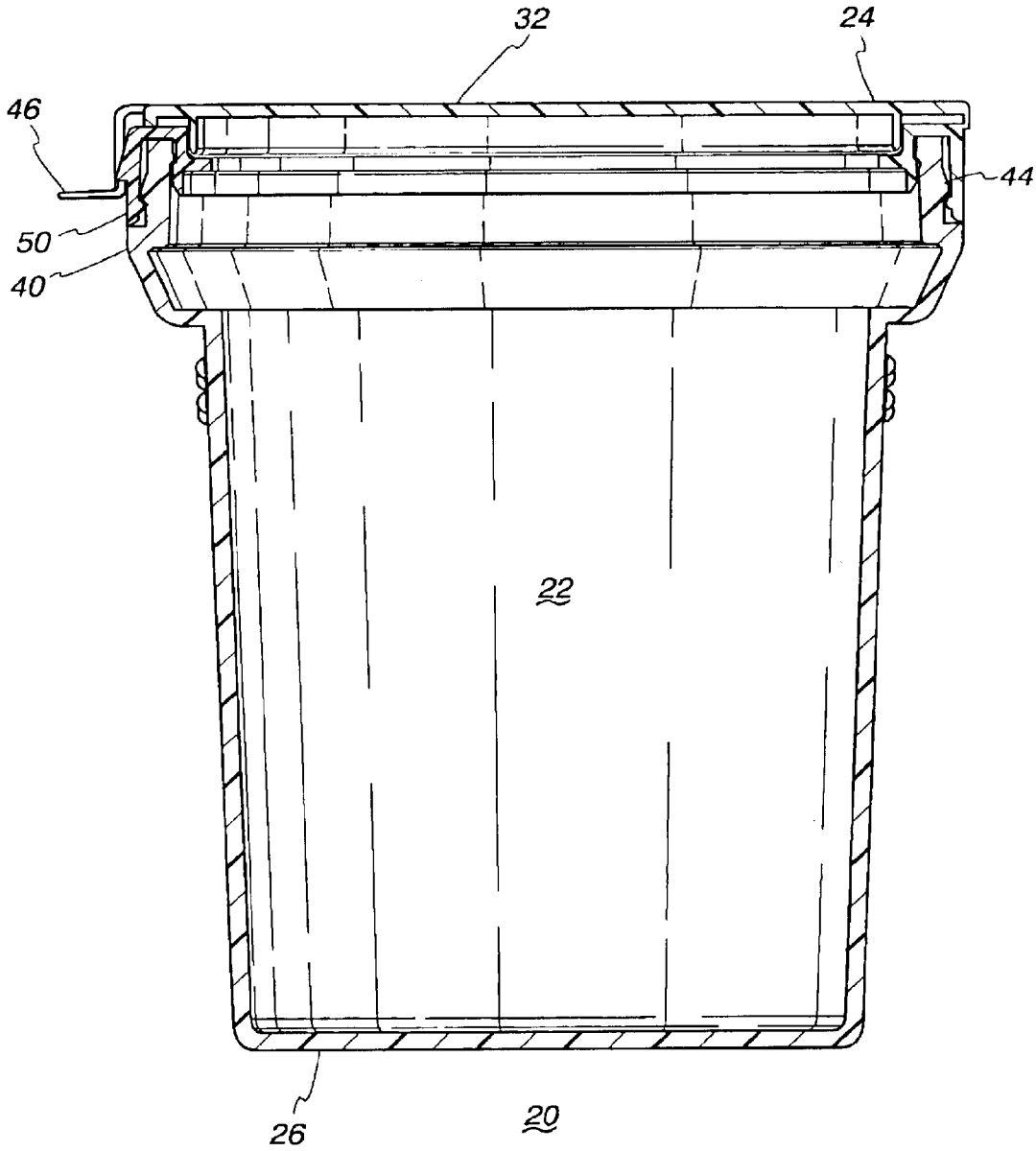
FIG. 3 is a cross-sectional view from the side illustrating the container of FIG. 1 in closed position.
Figure 4:
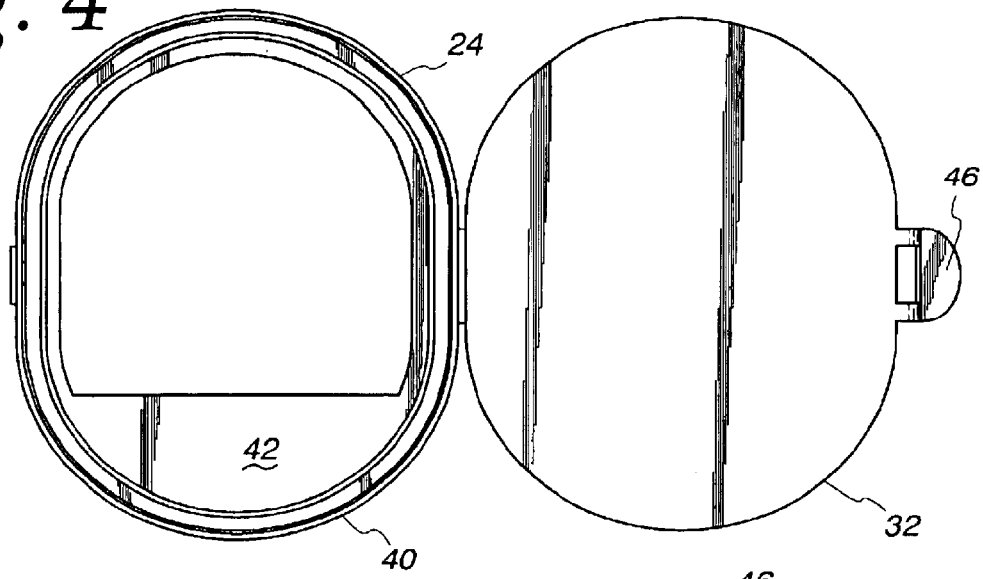
FIG. 4 is a plan view of the closure of the container of FIG. 1 in open position.

The invention is preferably embodied in a container 20 for viscous dressing products that includes a jar 22 and closure 24. In the preferred embodiments, the container is used in combination with viscous dressing products, e.g., mayonnaise or other viscous salad dressing, but in other embodiments the container may be used with other products including spreadable and/or spoonable products, granular or other particulate products, dry powders, grated cheese, liquids, etc.

For the purpose of illustrating the container of the invention, there are shown in the drawings, which form a material part of this disclosure, preferred embodiments of the invention. The various components of the container of the invention may be generally arranged as shown in the drawings, or as described hereinbelow. However, the invention is not limited to the precise arrangements, configurations, dimensions and/or instrumentalities shown in these drawings, or described hereinbelow. The arrangements, configurations, dimensions and instrumentalities may be otherwise, as circumstances require.

In the drawings, like reference symbols indicate the same components throughout the different views.

Figure 9:
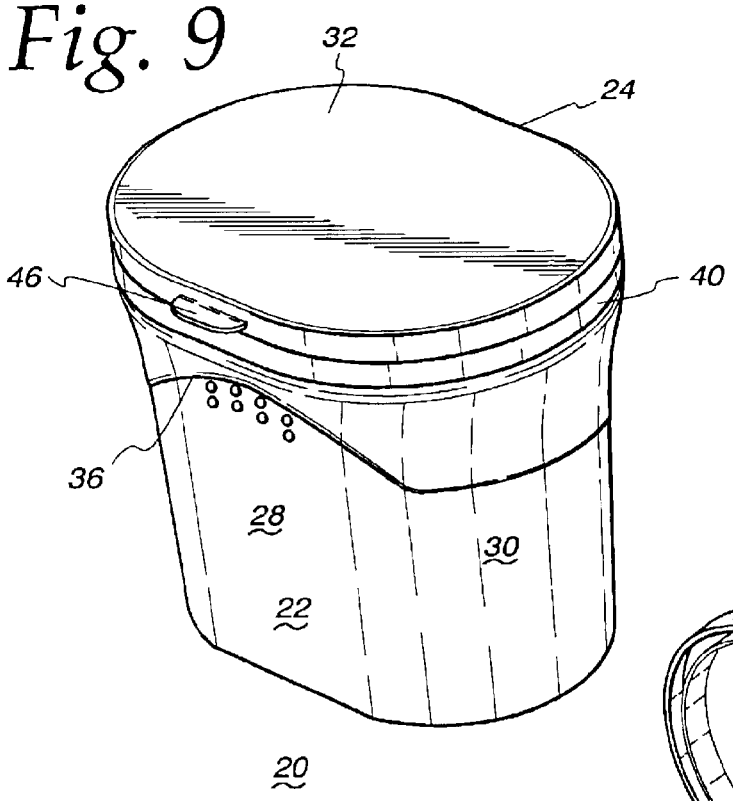
FIG. 9 is a perspective view illustrating a container in closed position in accordance with a third embodiment of the invention.
Figure 10:
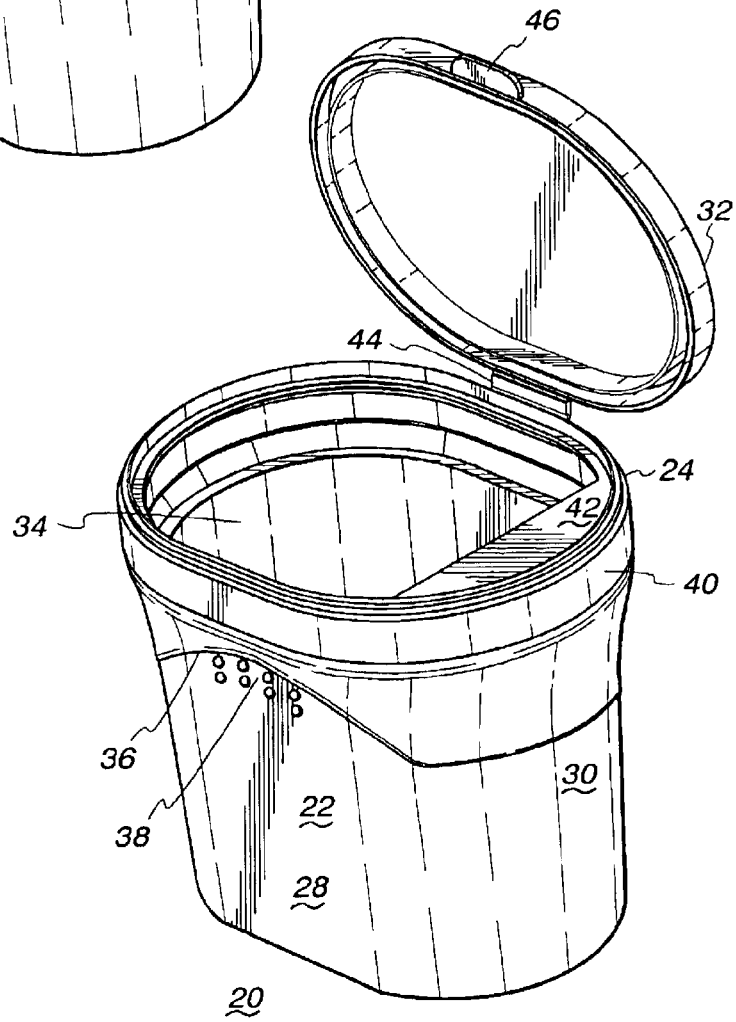
FIG. 10 is a perspective view illustrating the container of FIG. 9 in open position.
Figure 11:
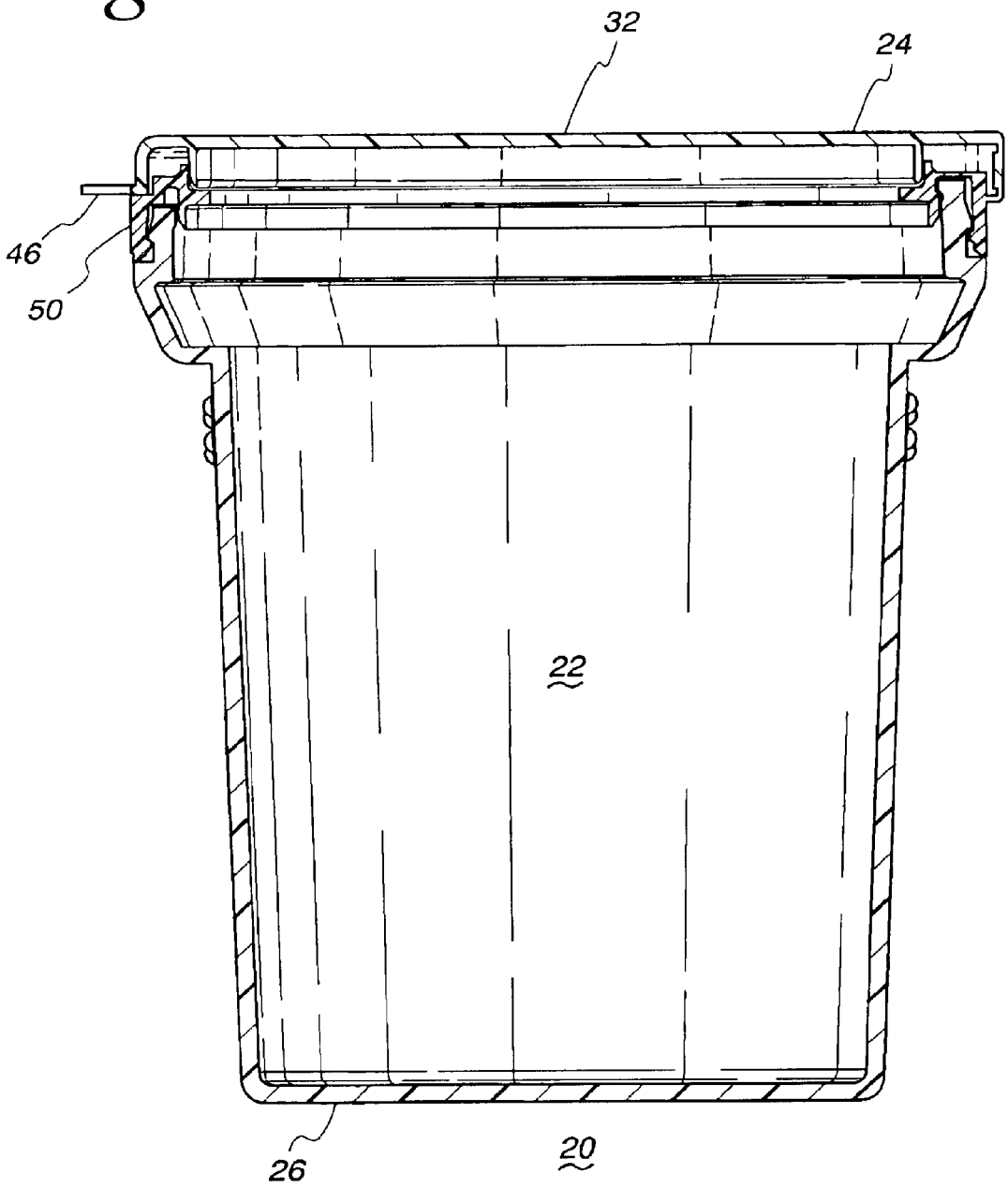
FIG. 11 is a cross-sectional view from the side illustrating the container of FIG. 9 in closed position.
Figure 12:
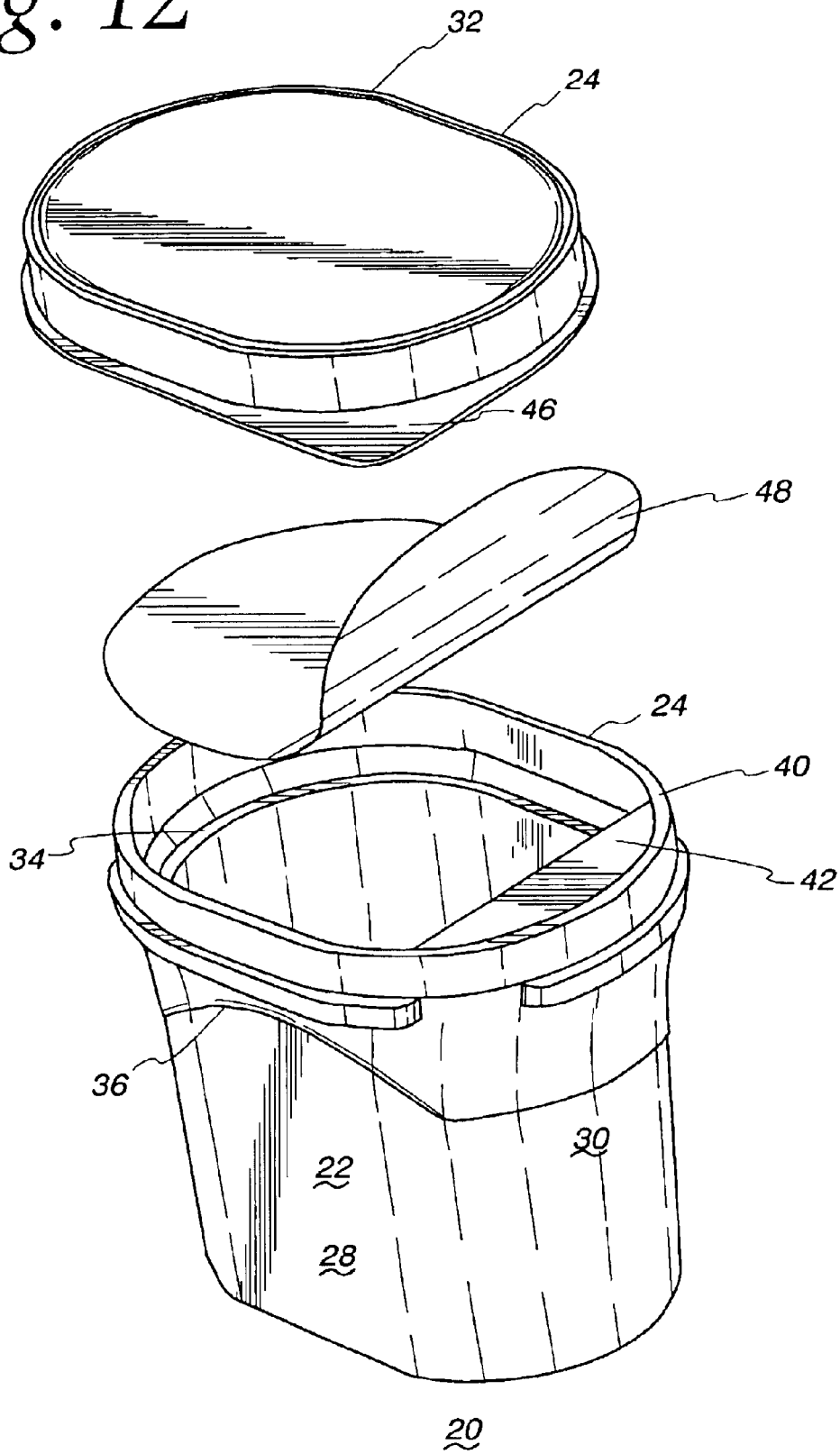
FIG. 12 is an exploded perspective view illustrating a fourth embodiment of the invention.
Figure 13:
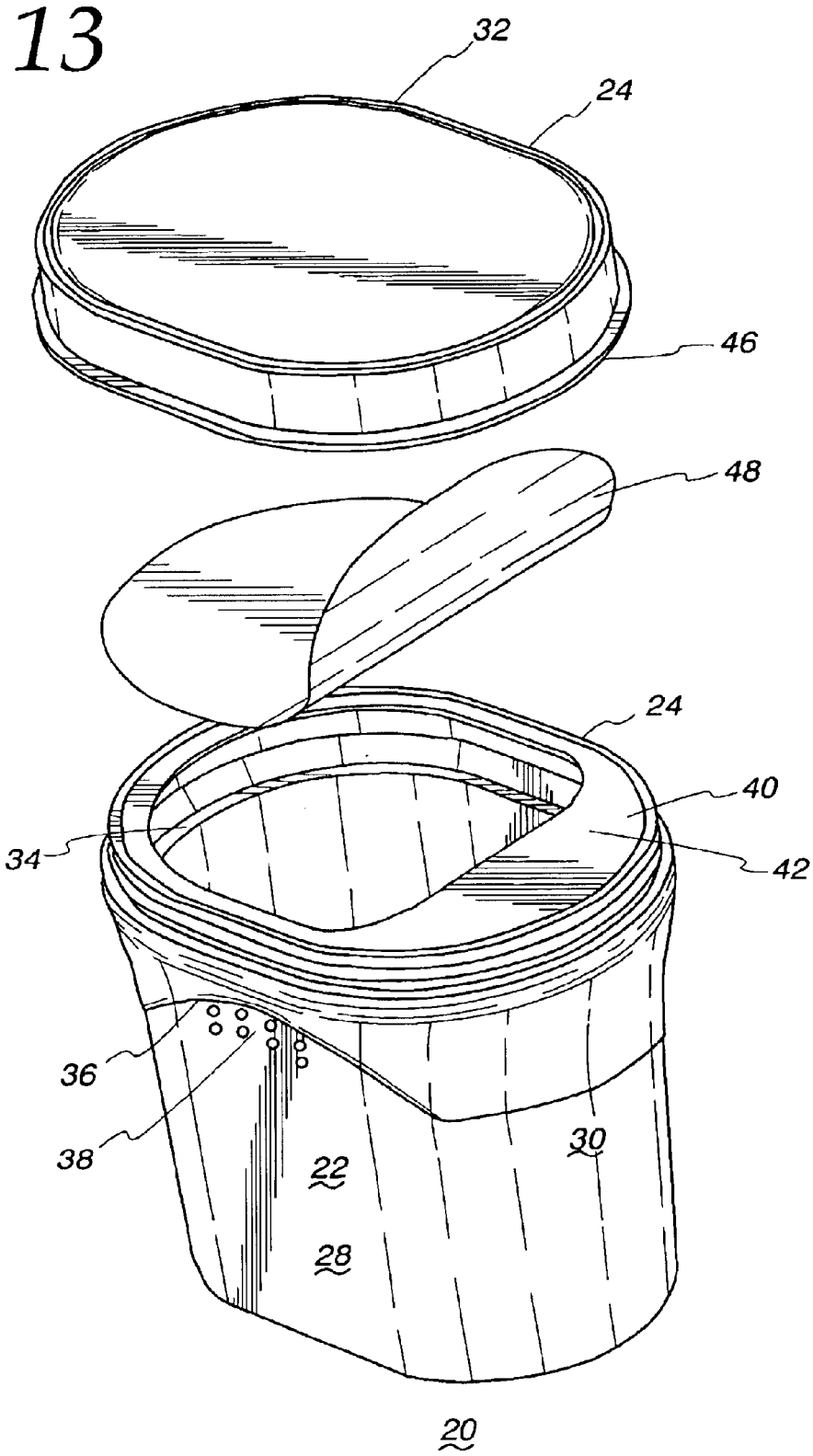
FIG. 13 is an exploded perspective view illustrating a fifth embodiment of the invention.
Figure 14:
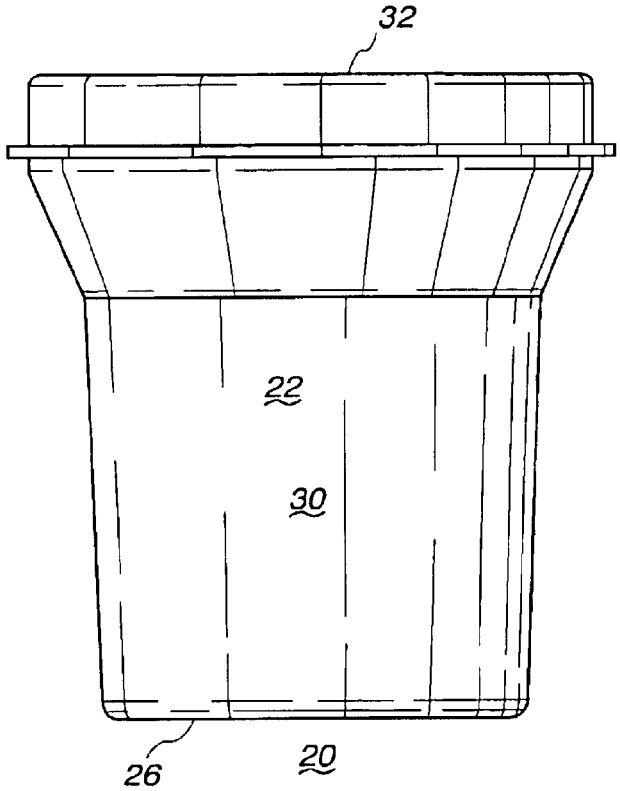
FIG. 14 is a side elevational view illustrating the container of FIG. 13.
Figure 15:
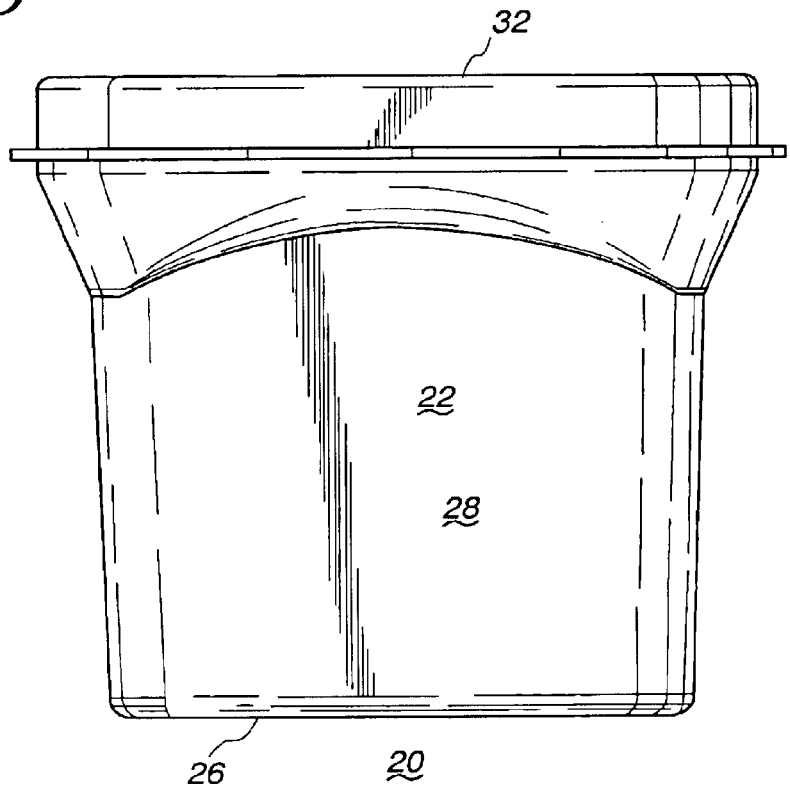
FIG. 15 is an end elevational view illustrating the container of FIG. 13.

FIGS. 1–11 show containers for viscous dressing products with three different closures. FIGS. 5–8 show a second embodiment. FIGS. 9–11 show a third embodiment. FIG. 12 shows a fourth embodiment. FIGS. 13–15 show a fifth embodiment.

The container 20 defines an enclosed interior space for containing viscous dressing product. The container includes a jar 22 having a bottom wall 26, side walls 28 and end walls 30, and a closure 24 comprising a lid 32 to sealably close the container. The lid 32 has a surface along its edge which permits the consumer to readily open the container by inserting a digit beneath a surface of the lid and reversibly lifting the lid off the container. The lid is hingedly attached to the container so as to remain attached to said container after opening. The closure provides an opening 34 large enough to permit dispensing of viscous dressing products by insertion of a serving spoon.

The jar 22 and closure 24 of the container 20 may be injection molded, thermoformed, extrusion blow molded or otherwise manufactured from any suitable material, and are preferably made of a plastic material such as polypropylene, high density polyethylene, low density polyethylene, polyester, nylon, polystyrene, polycarbonate, polyethylene terephthalate or various multi-layer plastic substrates, polyurethane, and the like.

The height of the preferred container may range from about 5 to about 7 inches, and is preferably about 5.75 inches. The width of the top of the preferred container may range from about 4 inches to about 7 inches, and is preferably about 4.75 inches. The depth of the container may range from about 3 inches to about 6 inches, and is preferably about 3.75 inches. The width of the opening of the preferred container may range from about 3 inches to about 5 inches, and is preferably about 4 inches. The depth of the opening of the preferred container is about 2 inches to about 4 inches, and is preferably about 3 inches.

The Jar

In the preferred embodiments, the shape of the jar 22 is generally oval, with the sidewalls generally flat, and the end walls being generally semicircular. The jar has a wide opening 34, which preferably is oval shaped.

To improve the handling characteristics of the jar, and specifically to provide an ergonomic improvement to the ability of the jar to be held securely by a consumer with one hand, while also providing improved access to the contents, the side walls 28 and the end walls 30 of the jar are stepped and/or flared outward near their upper ends, over about the top 20% to 30% of the end walls, and about the top 15% to 30% of the side walls. Thus, the entire upper periphery of the jar is enlarged, and preferably presents gently curved concave surfaces with large radii of curvature to engage the thumb and fingers of the user.

In the illustrated embodiments, a concave brow ridge 36 is provided near the top of each side wall. The brow ridge 36 is preferably undercut and curved in a crescent shape as shown, and is angled outward and upward from the lower portion of the side wall. Preferably the brow ridge is curved to define a recess for stably engaging the thumb of a consumer gripping the container. The brow ridge 36 extends from about 2.5 to about 4.0 inches across the side wall, and angles upward toward the lid of the container at an angle of about 10° to 20°. Alternatively, the brow ridge may be a straight protruding ridge parallel to the top edge of the container.

Beneath the brow ridge 36, a textured area 38 further improves the handling characteristics of the container. The textured area 38 may consist of raised circular beads beneath and adjacent to the brow ridge, as depicted in FIGS. 1, 2, 4, 6, 9 and 10. Alternatively, the textured area may comprise vertical ribs, raised hatching, horizontal or vertical ridges, or other three dimensional patterns of linear or curved configurations.

The combination of the brow ridge 36 and the textured area 38 adjacent to the brow ridge serves to provide the consumer with a convenient and easy mode of gripping the container so that it should not easily slip out of the consumer's hand. The consumer may have wet hands from working in the kitchen, and the brow ridge and textured area beneath it lends assurance to the consumer that the jar will not slip out of his or her hand.

In one embodiment, the side walls 28 beneath the brow ridge and textured area are relatively flat and the side walls include label panels. The container is stackable with other like containers, and the wide label panels of the containers provide visual impact in a display, particularly when a large number of the containers are included in the display.

The container may be suggestive of a slice of bread as viewed from the front, in that its size and shape are generally similar to those of a slice of bread, and in that the curvature of the brow ridge is suggestive of the rounded top crust of a loaf of bread.

Preferably, the jar 22 is securely and permanently attached to the closure 24, with the lid 32 of the closure sealably closing the container as desired by the consumer. In one embodiment, the jar may be detached from the closure, allowing the consumer to clean the jar of viscous dressing product, and to clean the closure of the viscous dressing product, so that the combination of jar and closure may be used for storing other items. See FIG. 6.

The Closure

The closure comprises a body 40 or base for attachment to the jar, and a lid 32 to sealably close the container. The lid preferably has a surface along its front edge which permits the consumer to readily open the lid by inserting a digit beneath a surface of the lid and lifting the lid. The closure is preferably oval-shaped, to fit atop an oval-shaped jar. The base of the closure has a wide opening to permit a consumer to remove viscous dressing product using a serving spoon, knife or other utensil. Within the closure is a shelf or wiper blade 42 to permit the consumer to wipe excess viscous dressing product from the utensil. The shelf 42 overhangs the interior of the jar so that when a knife blade, spoon, or other utensil is drawn upward, the food product can be wiped from the utensil by the edge, and any accumulation may remain on the bottom surface of the shelf.

Figure 5:
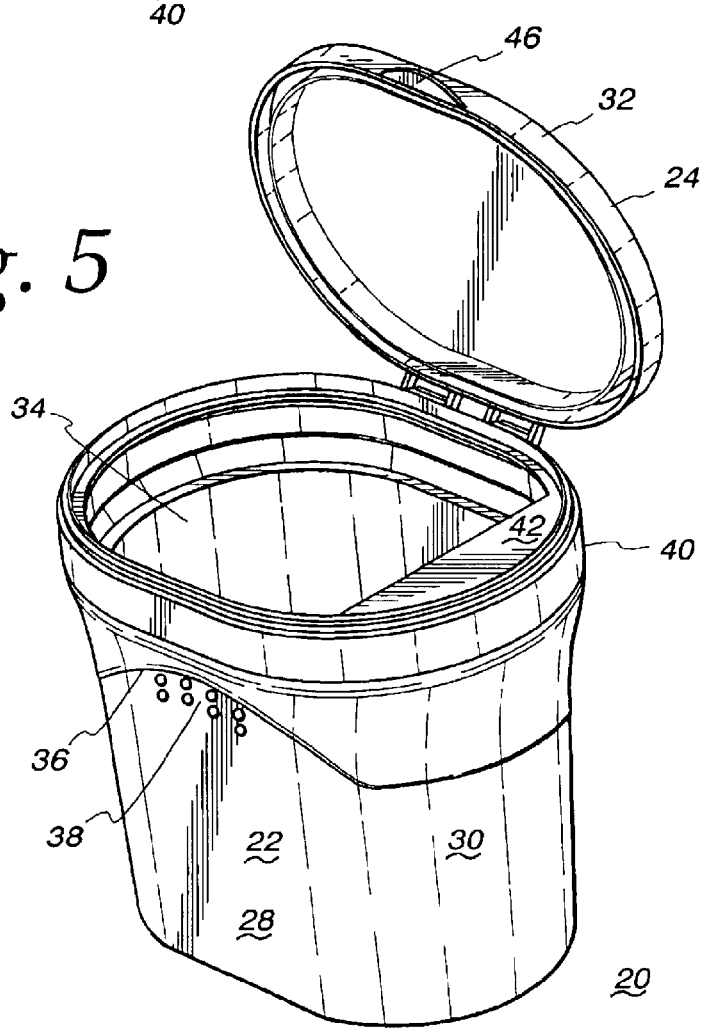
FIG. 5 is a perspective view illustrating a container in open position in accordance with a second embodiment of the invention.
Figure 6:
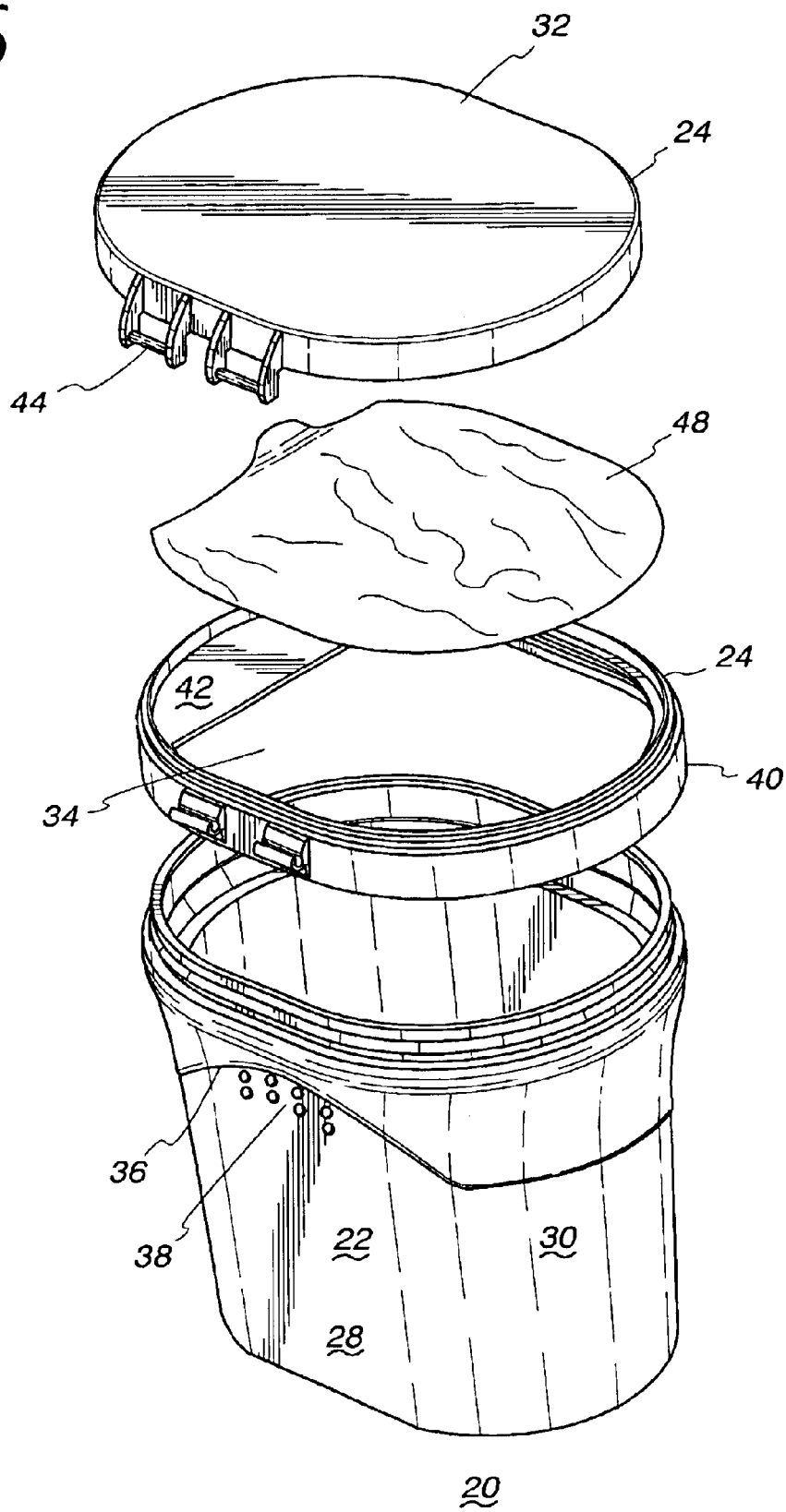
FIG. 6 is an exploded perspective view illustrating the container of FIG. 5.
Figure 7:
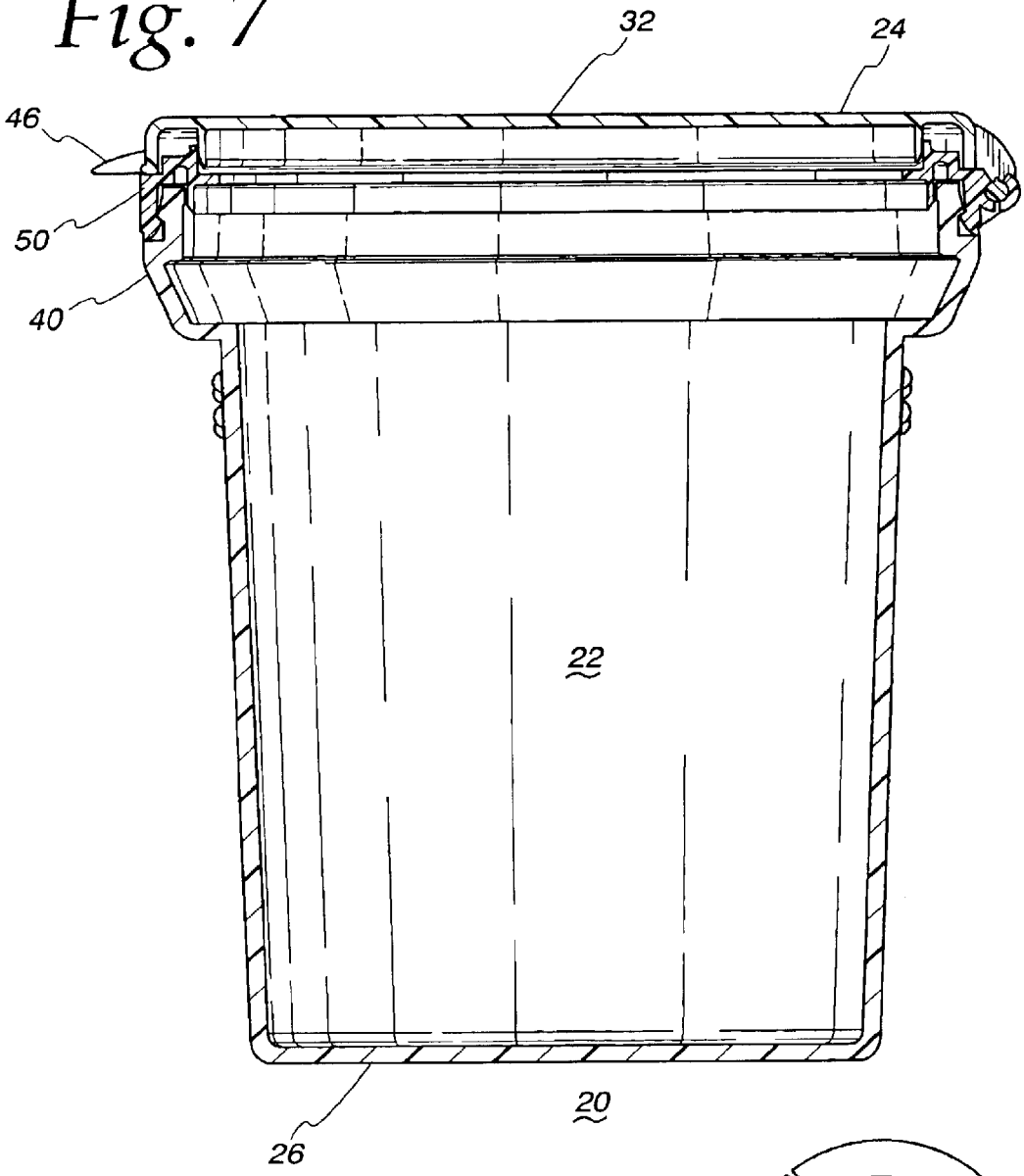
FIG. 7 is a cross-sectional view from the side illustrating the container of FIG. 5 in closed position.
Figure 8:
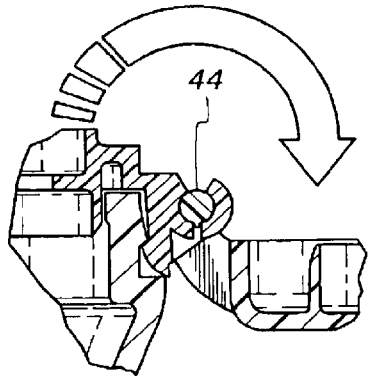
FIG. 8 is a cross-sectional view from the side illustrating the hinge of the container of FIG. 5.

The closure may be manufactured in a variety of embodiments, five of which are illustrated in FIGS. 1–15. Preferably, the lid is attached to the body of the closure by a hinge 44. The hinge may consist of a single piece of flexible material attaching the lid to the body of the closure, as depicted in FIGS. 2–4 and FIGS. 10–11. Alternatively, the hinge 44 may comprise two or more separate, interfitting elements pivotally attaching the lid to the body of the closure, as illustrated in FIGS. 5 and 6. In addition, the lid on the closure may be completely detachable, as shown in FIGS. 12–15.

The surface to facilitate opening may comprise a tab 46 at the junction of the side wall and the end wall (FIG. 12). Alternatively, the surface may comprise a tab 46 centered relative to the side wall opposite the hinge(s) (FIGS. 1–11), or the surface may be an extension which protrudes from the bottom edge of the lid extending all the way around the perimeter of the lid. The surface may also comprise any other type of extension that permits the consumer to insert a digit to lift up the lid and open the container.

The base or lower portion of the closure may include a recess or an interruption positioned to facilitate engagement of the lifting surface.

The lifting surface or tab 46 may also function as part of a snap lock 50 or other mechanism to hold the lid in place once the lid is closed. To this end, a surface may be provided on the body of the closure over which the lifting surface fits when the lid is closed.

The snap action lock 50 sealing mechanism of the lid and closure is desirable for several reasons. It is easy for the consumer to use. It is especially easy for a busy family member to snap the lid shut after reaching for the open jar with the hinged lid hanging open. The snap-on mechanism permits the avoidance of accumulation of viscous dressing product on the edge of the closure. Thus, the container of the invention is easier to keep clean than viscous dressing product containers with screw-on lids. The lid may be manufactured so as to lock onto the body of the closure with a snapping sound, thus confirming to the consumer that the lid is sealed in place.

The closure may be made tamper-evident with a removable or frangible foil 48 or plastic seal across the closure. This seal preferably covers the opening 34 and the wiper blade 42. (See FIG. 6).

We claim:

1. A container capable of receiving a food product and which facilitates the removal of the food product for consumption, the container comprising:

a bottom wall;

a pair of sidewalls having flat lower portions, each sidewall having a brow ridge protruding near the top of the sidewall, the brow ridge being curved upward between its ends;

a pair of end walls, the bottom, sidewalls and end walls forming an interior of the container; and a hinged lid;

the side walls and end walls being stepped or flared outward near their upper ends to form an upper end flared portion which has an enlarged internal volume and which flared portion has at least one peripheral circumference which is greater than the peripheral circumference of the bottom wall, upper end flared portion terminating in a top lip and defining a top opening in the container, the flared portion effective for providing access and removal of food;

a wiper edge in the upper end flared portion extending inwardly into the interior of the container such that the wiper blade overhangs the interior of the container, the wiper blade in a plane which is over and parallel to the bottom wall; and a snap lock effective for holding the lid over the top opening;

wherein the sidewalls are generally flat and the end walls generally semicircular, and wherein said hinged lid is effective for covering the top opening.

2. A container in accordance with claim 1 wherein said brow ridge is curved over its entire length to define a recess for stably engaging the thumb of a user.

3. A container in accordance with claim 2 wherein said ridge is crescent shaped.

4. A container in accordance with claim 3 wherein said end walls are flared outward over the top 20% to 30%.

5. A container in accordance with claim 4 wherein said side walls are flared outward over the top 15% to 30%.

6. A container in accordance with claim 5 wherein said container further includes a textured area beneath and adjacent to the ridge.

7. A container in accordance with claim 6 wherein the container is capable of being held securely in one hand, with the thumb under the ridge of one sidewall, and fingers engaging the opposite sidewall.

8. A container in accordance with claim 7 wherein the upper periphery of the container presents gently curved concave surfaces with large radii of curvature to engage the thumb and fingers of the user.

9. A container in accordance with claim 8 wherein the brow ridge is angled outward and upward from a lower portion of the sidewall.

10. A retail food product and container comprising:

a quantity of a food product; and a hermetically sealed container capable of receiving the food product in high speed commercial filing operations, comprising a bottom wall, a pair of sidewalls having flat lower portions, each sidewall having a brow ridge protruding near the top to the sidewall, a pair of end walls, and a hinged lid, the bottom, sidewalls and end walls forming an interior of the container, the brow ridge being curved upward between its ends;

the side walls and end walls being stepped or flared outward near their upper ends to form an upper end flared portion which has an enlarged internal volume and which flared portion has at least one peripheral circumference which is greater than the peripheral circumference of the bottom wall, the upper end flared portion terminating in a top lip and defining a top opening in the container, the flared portion effective for providing access and removal of food;

a wiper edge in the upper end flared portion extending inwardly into the interior of the container such that the wiper blade overhangs the interior of the container;

a snap lock effective for holding the lid over the top opening; and wherein the sidewalls are generally flat and the end walls generally semicircular, and wherein said hinged lid is effective for covering the top opening.

11. A container in accordance with claim 10 wherein said brow ridge is curved over its entire length to define a recess for stably engaging the thumb of a user.

12. A container in accordance with claim 11 wherein said ridge is crescent shaped.

13. A container in accordance with claim 12 wherein said end walls are flared outward over the top 20% to 30%.

14. A container in accordance with claim 13 wherein said side walls are flared outward over the top 15% to 30%.

15. A container in accordance with claim 14 wherein said container further includes a textured area beneath and adjacent to the ridge.

16. A container in accordance with claim 15 wherein the container is capable of being held securely in one hand, with the tumb under the ridge of one sidewall, and fingers engaging the opposite sidewall.

17. A container in accordance with claim 16 wherein the food product is mayonnaise.

18. A container in accordance with claim 17 wherein the upper periphery of the container presents gently curved concave surfaces with large radii of curvature to engage the thumb and fingers of the user.

19. A container in accordance with claim 18 wherein the brow ridge is angled outward and upward from a lower portion of the sidewall.

20. A container capable of receiving a food product and which facilitates the removal of the food product for consumption, the container comprising:

an oval shaped bottom wall;

a pair of generally flat sidewalls effective for having a label applied thereon;

at least one sidewall having a crescent shaped brow ridge defined by a recess in the side wall, the brow ridge protruding near the top of the sidewall, the at least one brow ridges being curved upward between its ends;

a pair of semi-circular shaped end walls which are smaller in area than the side walls, the bottom, sidewalls and end walls forming an interior of the container; and a hinged lid;

the side walls and end walls being stepped or flared outward near their upper ends to form an upper end flared portion of the container which upper end flared portion has at least one peripheral circumference which is greater than the peripheral circumference of the bottom wall, the upper end flared portion terminating in an oval shaped top lip which defines a top opening in the container, the flared portion effective for providing access and removal of food, the hinged lid effective for covering the top opening;

a wiper edge in the upper end flared portion extending inwardly into the interior of the container; and a snap lock effective for holding the lid over the top opening.

21. A container in accordance with claim 20 wherein the lid includes the wiper edge.

22. A container in accordance with claim 21 wherein the wiper edge is perpendicular to the hinge.

23. A container capable of receiving a food product and which facilitates the removal of the food product for consumption, the container comprising:

a bottom wall;

a pair of sidewalls having flat lower portions, each sidewall having a crescent shaped brow ridge defined by a recess in each sidewall, the brow ridges protruding near the top of the sidewalls, the brow rides being curved upward between their ends;

a pair of end walls, the bottom, sidewalls and end walls forming an interior of the container, the side walls and end walls being stepped or flared outward near their upper ends to form an upper end flared portion which has an enlarged internal volume and which flared portion has at least one peripheral circumference which is greater than the peripheral circumference of the bottom wall, the upper end flared portion terminating in a top lip and defining a top opening in the container, the flared portion effective for providing access and removal of food;

a detachable closure assembly which is detachably engageable with the upper end flared portion of the sidewalls and end walls, the closure assembly including a closure body, a snap lock and a hinged lid, the closure body having a wiper edge extending inwardly into the interior of the container such that the wiper blade overhangs the interior of the container, the snap lock effective for holding the lid to the closure body over the top opening;

said brow ridge being curved upward between its ends;

wherein the sidewalls are generally flat and the end walls generally semicircular, and wherein said hinged lid is effective for covering the top opening.

24. A container in accordance with claim 23 wherein the wiper edge is perpendicular to the hinge.

* * * * *

UNITED STATES PATENT AND TRADEMARK OFFICE

CERTIFICATE OF CORRECTION

PATENT NO. : 6,772,904 B1
DATED : August 10, 2004
INVENTOR(S) : Gilliam et al.

It is certified that error appears in the above-identified patent and that said Letters Patent is hereby corrected as shown below:

Column 7,
Line 3, change “tumb” to -- thumb --.
Line 23, change “ridges” to -- ridge --.
Line 23, change “ends” to -- end --.

Signed and Sealed this

Fourth Day of January, 2005

JON W. DUDAS
*Director of the United States Patent and Trademark Office*